United States Patent [19]

Kimble et al.

[11] 4,019,418

[45] Apr. 26, 1977

[54] ORGAN STOP TABLET MECHANISM

[75] Inventors: Thomas E. Kimble, Covington, Ky.; Marion B. Gregory, Cincinnati, Ohio

[73] Assignee: D. H. Baldwin Company, Cincinnati, Ohio

[22] Filed: Apr. 1, 1976

[21] Appl. No.: 672,598

[52] U.S. Cl. ..... 84/343; 84/227; 84/369; 84/434; 200/339

[51] Int. Cl.[2] ..... G10B 3/10; G10C 3/12

[58] Field of Search ..... 84/85, 225, 227, 229, 84/343, 345, 369, 433, 434, 435, 443; 200/339

[56] References Cited

UNITED STATES PATENTS

| | | | |
|---|---|---|---|
| 484,500 | 10/1892 | Ivers | 84/227 |
| 1,901,552 | 3/1933 | Dargis | 84/345 |
| 3,422,720 | 1/1969 | Johnson | 84/435 |
| 3,965,791 | 6/1976 | Thomas et al. | 84/343 |
| 3,974,347 | 8/1976 | Lockard | 200/339 |

*Primary Examiner*—Stephen J. Tomsky
*Attorney, Agent, or Firm*—Melville, Strasser, Foster & Hoffman

[57] ABSTRACT

A stop tablet mechanism particularly suited for electric organs wherein a plurality of stop tablets lie in closely spaced apart side-by-side relation, the stop tablets being pivotally mounted in a supporting frame by means of locating ears which are maintained in positive pivotal contact with the frame by pairs of wire springs, the wire springs engaging cam defining laterally projecting shoulders on the tablets and performing the additional function of maintaining the tablets in either of two positions of use, the spring elements being configured to provide flexibly mounted detent points which coact with the noses of the cam surfaces to maintain the tablet in its desired position of use.

18 Claims, 5 Drawing Figures

ORGAN STOP TABLET MECHANISM

BACKGROUND OF THE INVENTION

This invention relates to tablet type switching devices and more particularly to stop tablets for use in electric organs wherein a number of stop tablets are arranged in side-by-side relation to enable the organist to produce a wide variety of tonal effects.

While numerous types of stop tablets have hitherto been proposed, they generally have been of relatively complicated and expensive construction, and have additionally presented a number of disadvantages both from the standpoint of installation and subsequent servicing. If each tablet comprises an individual unit, additional space is usually required to install the units, as well as the added time and cost involved for individual installation. In other installations wherein a number of stop tablets are assembled as a unit, the economies effected have been offset by other disadvantages, such as the necessity to disassemble the entire unit where repair or replacement of a single stop is required.

Stop tablet mechanisms have also been proposed wherein various types of spring means have been utilized to suspend or cradle the tablets for movement to their alternate positions of use, with the spring means additionally serving to maintain the tabs or actuating members in engagement with the housing or other support on which they are mounted. A principal objection to such arrangements lie in the instability of the tablets and the inability of the spring means to provide a firm and uniform support for the tab, particularly should fatigue be encountered in the spring members which additionally may be utilized to act as contact arms to effect electrical connection between the switch contacts.

The stop tablet switch mechanism in accordance with the present invention overcomes the various difficulties and disadvantages encountered in prior art devices by providing a stop tablet mechanism having the attributes and advantages which will now be summarized.

SUMMARY OF THE INVENTION

In accordance with the present invention, any desired number of stop tablets may be mounted on a one-piece steel frame provided with a common slotted and printed mask which serves to identify the function of all the tablets in the group, the tablets being on relatively close center spacing to permit greater density for a given space; yet the tablets are totally independent of each other and can be individually removed for repair or replacement.

The tablets themselves are of essentially one-piece construction and may be readily molded from numerous plastic materials, the exposed actuating surfaces being provided with interchangeable inserts which may be varied in color from tablet to tablet when color coding is desired, thereby eliminating the necessity for providing the entire tablets in different colors, as has heretofore been the common practice.

The tablets are provided with integral locating ears engageable with slots in the supporting frame, the arrangement being such that the tablets are positively supported by the frame and cannot be misaligned or caused to bind either during installation or in use. To this end, essentially planar supporting surfaces are provided adjacent the locating ears which bear the force of the pivoting movement of the tablets as well as relieve the ears from the bulk of the pivot controlling function, which function is borne by the detent springs which serve the dual function of maintaining the tablets in firm yet movable contact with the supporting frame and providing the detenting function for two-position tablet operation.

The springs are each provided with a detent point configured to coact with the nose of the cam forming shoulder with which it is associated to provide an over-center "snap" as the tablet is displaced from one position of use to the other. The detent point of the spring is free to travel laterally as the tablet is displaced, such lateral travel of the spring serving to enhance the detenting action as well as eliminating possible binding of the parts which might occur as between the opposite shoulders of the tabs were they reacting against rigid detent points.

DESCRIPTION OF THE PREFERRED EMBODIMENT

Figure 1:
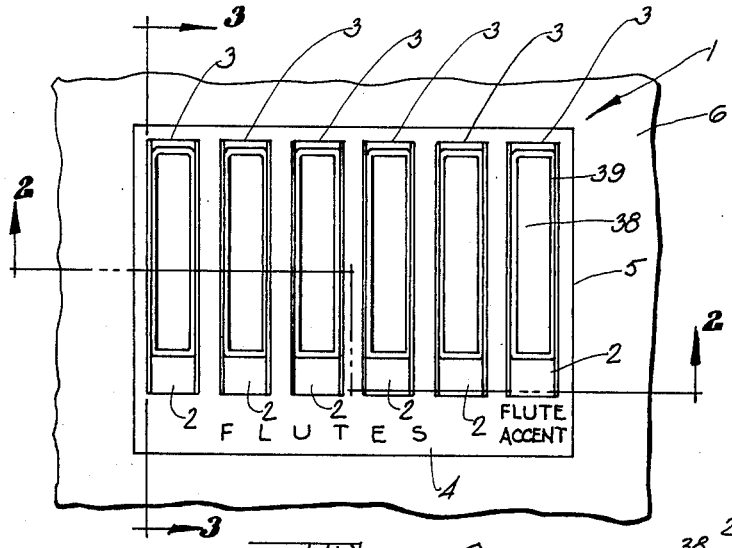
FIG. 1 is a plan view of organ stop tablet mechanism in accordance with the invention.
Figure 2:
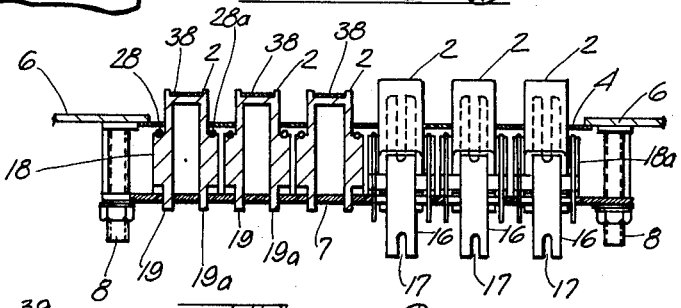
FIG. 2 is a vertical sectional view taken along the irregular line 2—2 of FIG. 1.
Figure 3:
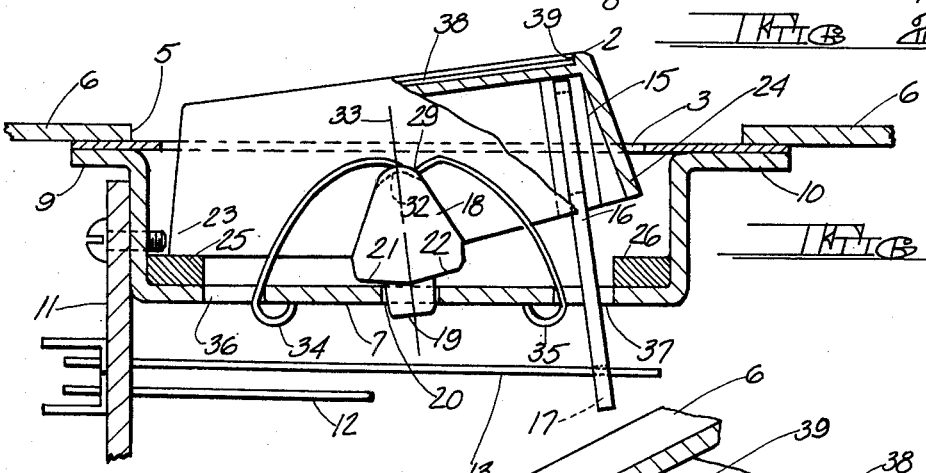
FIG. 3 is a vertical sectional view with parts broken away taken along the line 3—3 of FIG. 1.
Figure 4:
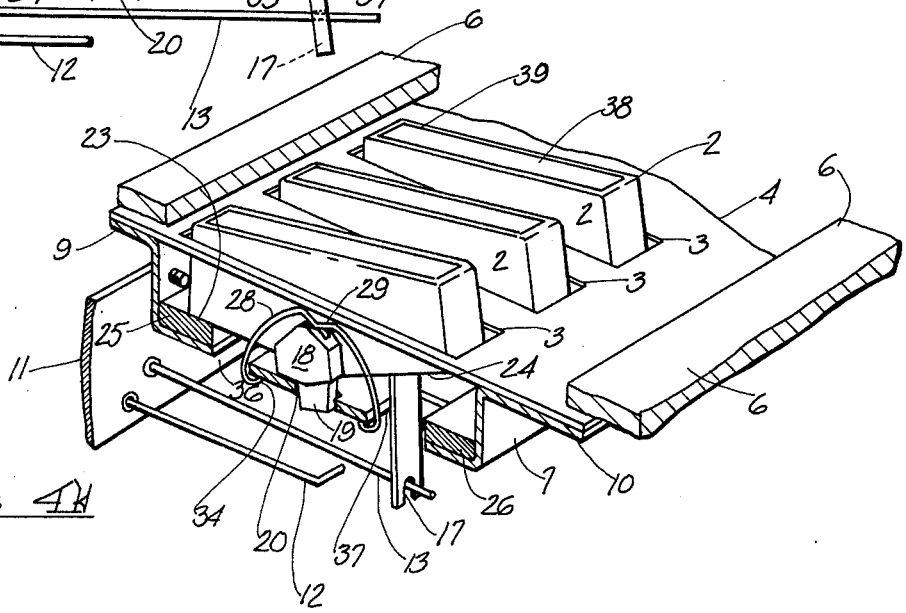
FIG. 4 is a fragmentary perspective view of the stop tablet mechanism with parts broken away.

Referring first to FIG. 1, an organ stop tablet in accordance with the invention is indicated generally at 1, the mechanism in this instance comprising a series of six stop tablets 2 arranged in side-by-side relation and projecting upwardly through openings 3 in a tab identification mask 4 which covers opening 5 in organ control panel 6. As best seen in FIGS. 2 and 3, a metal frame 7 underlies the opening 5 in the control panel 6 and is secured thereto by mounting bolts 8, seen in FIG. 2, the arrangement being such that the identification mask 4 will be sandwiched between the marginal edges of the control panel 6 and the horizontally disposed flanges 9 and 10 of frame 7. The frame 7 mounts a contact board 11 to which sets of contact switches 12 and 13 are secured, a set of such switches being positioned beneath each of the stop tablets 2, as will be readily apparent from FIGS. 3 and 4.

The stop tablets 2 are preferably molded from plastic material and are hollow, the tablets having a spaced apart pair of channel defining internal walls 14 and 15, seen in FIG. 3, in which the upper end of an elongated contact actuator 16 is snugly received, the actuator also preferably being plastic and having a slot 17 at its lowermost end positioned to engage and deflect flexible contact switch 13 into contact with underlying flexible contact switch 12 when the tablet is moved from one position of use to the other.

Each tablet has an identical pair of laterally projecting shoulders 18, 18*a*and a pair of depending ears 19, 19*a*adapted to be received in spaced apart slots 20 in frame 7, the slots being of a size to receive the ears without binding yet sufficiently snug to maintain the tablets in accurate alignment on the supporting frame. Since the tablet is hollow, the ears may be displaced relative to each other, when necessary, in order to fit into the slots 20. The undersurface of each of the shoulders 18, 18*a*is configured to provide a pair of angularly related essentially planar supporting surfaces 21 and 22 adapted to selectively contact the frame 7 adjacent the slots 20, the arrangement being such that the tablet will be seated on the surface 21 when in the position of use illustrated in FIG. 3, whereas the tablet will be seated on the surface 22 when in its other position of use. In addition, the opposite end edges of the tablet, indicated at 23 and 24, will seat on the felt stop strips 25 and 26, respectively, depending upon the position of the tablet. In either position the tablet is firmly seated and stabilized, the depending ears 19, 19*a*maintaining the tablet in accurate alignment and at the same time permitting it to be rocked from one position to the other.

Figure 5:
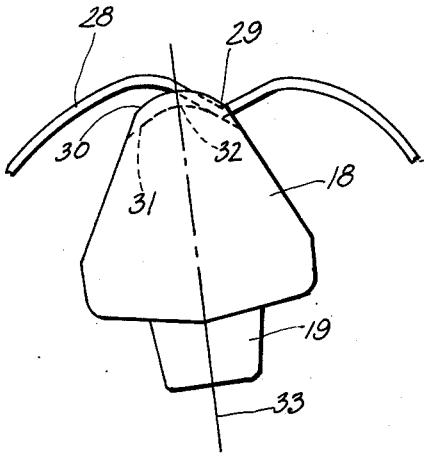
FIG. 5 is an enlarged fragmentary side elevational view of the detent spring and cam nose.

Each tablet is provided with a pair of detent springs 28, 28*a*which are of generally semi-circular configuration but with their center portions reversely bent to define an inwardly directed detent point 29 which engages the uppermost surface of the underlying shoulder 18 or 18*a*, as the case may be. As best seen in FIG. 5, each spring rides in a recess or channel 30 the bottom of which defines a nose-shaped cam surface 31 having its apex 32 coinciding with the centerline 33 of the tablet. The outermost ends of the springs are reversely bent to form hooks 34 and 35 (FIG. 3) which are adapted to engage beneath the frame 7, the frame being provided with sets of slots 36, 37 through which the ends of the springs are passed for engagement beneath the frame 7, the slots 37 additionally serving to permit the contact actuators 16 to project downwardly through the frame for engagement with the contact switches 13.

With the spring arrangement just described, the sets of detent springs 28, 28*a*serve the dual function of (*a*) retaining the tablets in assembled relation relative to the frame 7, and (*b*) providing the necessary detenting function to permit two-position tablet operation. As will be evident from FIGS. 3 and 5, which illustrate the tablet in one of its positions of use, the detent point 29 of the spring 28 lies to one side of the apex 32 of cam surface 31, thereby maintaining the tablet in the position illustrated, in which position the surface 21 is firmly seated on the underlying surface of frame 7 and the end edge 23 is seated on stop strip 25. As the tablet is rocked to its other position of use, the detent point 29 will ride upwardly along the cam surface 31 and will flex the spring as the apex 32 of the cam surface approaches the detent point 29. As the apex 32 passes the detent point 29, an over-center "snap" action will occur as the detent point travels downwardly along the downwardly inclined portion of cam surface 31 lying to the left of the apex 32, thereby urging the tablet to its opposite position of use in which the surface 22 is seated on the underlying portion of frame 7 and the end edge 24 is seated on stop strip 26. During this movement, the detent point of each spring is free to travel laterally due to the resiliency of the spring, thereby enhancing the detenting action. The detent points, being integral parts of the resilient springs, preclude binding of the parts as the tablets are rocked from one position to the other, and at the same time provide the desired over-center "snap" action which insures that the tablet will be fully seated in its intended position of use.

Another feature of the invention lies in the use of inserts 38 which may be adhesively secured in recesses 39 in the upper surfaces of the tablets to provide a means for identification. The inserts, which may comprise strips of thin plastic or foil, can be color coded or otherwise marked to identify the function of the tablet. All of the tablets thus may be molded in the same basic color, thereby eliminating the necessity to mold the entire tablet in a number of different colors, as has been the common practice. This expedient reduces production inventories as well as the number of replacement parts required, particularly since the insert, which preferably is secured to the tablet with a pressure sensitive adhesive, can be readily replaced.

As should now be evident, the instant invention provides a stop tablet mechanism which is of simple and relatively inexpensive construction and yet provides positive control over the rocking movement of the tablets. The tablets are at all times firmly seated on the supporting frame and are not subject to misalignment or possible binding. The detenting points 29 are free to flex and hence compensate for variations in tolerances or forces which might tend to cause binding of the parts, and yet, the tablet mechanism is stable and move from one position to the other with a positive snap action. The construction also permits the use of a common printed mask for as many tablets as desired and also permits color coding or other individual marking of the tablets at minimal expense and without the need for excess inventories of parts.

Modifications may be made in the invention without departing from its spirit and purpose, and it is not intended that the scope of the invention be limited other than in the manner set forth in the claims which follow.

The embodiments of the invention in which an exclusive property or privilege is claimed are defined as follows:

1. A stop tablet mechanism comprising a supporting frame, an elongated stop tablet seated on said frame, means mounting said stop tablet for pivotal movement to and from alternate positions of use, a pair of narrow shoulders projecting outwardly from the opposite sides of said tablet intermediate its opposite ends, the upper edges of said shoulders defining nose-shaped cam surfaces, detent springs having their opposite ends engaging said frame on opposite sides of said shoulders with their central portions engaging said nose-shaped cam surfaces, said springs having centrally disposed inwardly directed detent points adapted to follow the nose-shaped cam surfaces as the stop tablet is moved from one position of use to the other.

2. The stop tablet mechanism claimed in claim 1 wherein the undersurfaces of said shoulders define angularly related pairs of supporting surfaces adapted to be selectively seated on said supporting frame as the tablet is moved from one position to the other.

3. The stop tablet mechanism claimed in claim 2 wherein said angularly related pairs of supporting surfaces are essentially planar.

4. The stop tablet mechanism claimed in claim 1 wherein the means mounting the stop tablet for pivotal movement comprises depending ears engageable in slots in said frame.

5. The stop tablet mechanism claimed in claim 4 wherein said depending ears project downwardly from the opposite sides of the stop tablet in parallel relation thereto, the ear receiving slots in said frame being of a size to permit pivotal movement of the tablet yet maintain it in accurate alignment on said frame.

6. The stop tablet mechanism claimed in claimm 1 wherein the upper edges of said shoulders are of channel-shape with the bottoms of the channels defining the nose-shaped cam surfaces, and wherein the inwardly directed detent points of said springs ride in said channels.

7. The stop tablet mechanism claimed in claim 6 wherein the apexes of said nose-shaped cam surfaces coincide with the centerline of the tablet, said detent points traveling from one side to the other of the apexes of the cam surfaces as the tablet is moved from one position of use to the other.

8. The stop tablet mechanism claimed in claim 7 wherein the opposite ends of said detent springs extend through sets of slots in said frame and have reversely bent ends engaging the undersurface of said frame adjacent said last named sets of slots.

9. The stop tablet mechanism claimed in claim 8 including an elongated actuating bar projecting downwardly from said tablet adjacent one end thereof, said actuating bar projecting through a slot in said frame.

10. The stop tablet mechanism claimed to claim 9 wherein a plurality of said tablets are mounted in side-by-side relation on said frame, and a unitary mask supported by said frame, said mask having cut-outs therein through which the upper portions of said tablets project.

11. The stop tablet mechanism claimed in claim 9 including a pair of cushions supported on said frame in positions to be selectively contacted by the opposite ends of said tablet when in its alternate positions of use.

12. The stop tablet mechanism claimed in claim 1 wherein the upper surface of the tablet is recessed, and wherein a tablet identification strip is adhesively secured in said recess.

13. The stop tablet mechanism claimed in claim 12 wherein said identification strip is color coded.

14. In a stop tablet mechanism, an elongated stop tablet having a pair of narrow shoulders projecting outwardly from its opposite side edges, the upper edges of said shoulders being configured to define nose-shaped cam surfaces, the undersurfaces of said shoulders defining angularly related pairs of essentially planar supporting surfaces, and a pair of ears projecting downwardly from the opposite sides of the tablet in parallel relation to each other, the centerlines of said ears defining the centerline of said tablet, with the angularly related supporting surfaces in each said pair of supporting surfaces lying on opposite sides of the centerline of said tablet.

15. The stop tablet claimed in claim 14 including an elongated contact actuating bar detachably connected to and projecting downwardly from said stop tablet adjacent one end thereof.

16. The stop tablet claimed in claim 14 wherein the upper edges of said shoulders are of channel-shape configuration with the bottoms of the channels defining the nose-shaped cam surfaces.

17. The stop tablet claimed in claim 14 wherein the upper surface of said tablet is recessed, and wherein a tablet identification strip is adhesively secured in said recess.

18. The stop tablet claimed in claim 14 in combination with a pair of detent springs for securing said tablet to a supporting frame, said detent spring being of generally semi-circular configuration and having centrally disposed inwardly directed detent points adapted to follow said nose-shaped cam surfaces.

* * * * *